US005983396A

United States Patent [19]

Morrow et al.

[11] Patent Number: 5,983,396

[45] Date of Patent: Nov. 16, 1999

[54] PROTECTIVE SPORTS GLOVE

[75] Inventors: David Morrow, Farmington Hills, Mich.; Mark Roberts, Houston, Tex.

[73] Assignee: Warrior LaCrosse, Inc., Troy, Mich.

[21] Appl. No.: 09/143,924

[22] Filed: Aug. 29, 1998

Related U.S. Application Data

[60] Provisional application No. 60/057,277, Aug. 29, 1997.

[51] Int. Cl.[6] ..... A41D 13/08; A41D 19/00

[52] U.S. Cl. ..... 2/161.1; 2/16

[58] Field of Search ..... 2/159, 161.1, 161.6, 2/162, 16, 20

[56] References Cited

U.S. PATENT DOCUMENTS

| | | |
|---|---|---|
| 1,010,199 | 11/1911 | Stedman . |
| 1,841,193 | 1/1932 | Lidston . |
| 1,934,332 | 11/1933 | Skinner . |
| 3,605,117 | 9/1971 | Latina . |
| 4,411,024 | 10/1983 | Hayes . |
| 4,484,359 | 11/1984 | Tirinen . |
| 4,497,073 | 2/1985 | Deutsch . |
| 4,677,698 | 7/1987 | Angas . |
| 4,815,147 | 3/1989 | Gazzano et al. . |
| 4,930,162 | 6/1990 | Cote . |
| 5,237,703 | 8/1993 | Brine et al. . |
| 5,488,739 | 2/1996 | Cardinal . |
| 5,787,506 | 8/1998 | Wilder et al. . |

*Primary Examiner*—John J. Calvert
*Assistant Examiner*—Shirra L. Jenkins
*Attorney, Agent, or Firm*—Brooks & Kushman P.C.

[57] ABSTRACT

A protective sports glove having a hand protective portion having a palm portion, a thumb portion, and finger portions, interconnected by an inner fabric portion. An outer hand protective fabric structure is connected to the inner fabric and has a plurality of outer protective padded formations disposed over the hand protective fabric structure, the thumb portion, and the finger portions. The padded formations are formed such that one of the padded formations overlaps an adjacent padded portion so that some of the inner fabric is overlapped when the adjacent padded portions are moved with respect to one another. The glove also includes a wrist protective portion formed integral with the hand protective portion and a cuff portion coupled to the hand protective portion.

21 Claims, 5 Drawing Sheets

PROTECTIVE SPORTS GLOVE

CROSS-REFERENCE TO RELATED APPLICATIONS

The present application is claims priority from U.S. Provisional Application Ser. No. 60/057,277, filed Aug. 29, 1997 and entitled "Protective Sports Glove".

TECHNICAL FIELD

The present invention relates to a protective sports glove that provides improved protection for a player's fingers, hands, wrists, and lower forearms.

BACKGROUND ART

In contact sports such as lacrosse or hockey, where sticks are essential elements of the game, the hands and wrists are especially vulnerable to injury when being checked by another player's stick. For this reason, players typically utilize padded gloves to protect their hands, wrists, and lower forearms during play.

The flexibility of a players fingers and hands is often restricted due to the heavy padding protective with which typical protective gloves are constructed. Currently, some gloves have been designed with segmented padding in the finger and hand portions to reproduce the natural gripping position of a player's hands. U.S. Pat. No. 5,511,243 issued Apr. 30, 1996, to Hall et al., discloses a hockey glove having padded ribs fanning out from the point of the proximate knuckle on the index finger to allow for ergonomic flexing of the glove when the player's hand is gripping a hockey stick. The ribs are configured next to one another such that when the hand is gripping the stick, the ribs separate to form a right angle with respect to one another. However, if a player is struck on the hand while gripping the stick, the player's hands are not sufficiently protected at the seams where the ribs join. It is thus a problem to design the ribs that are ergonomic and protective.

Wrist guards are also known in the art and are widely used on lacrosse gloves to provide protection for a player's wrist between the cuff and the glove portion. U.S. Pat. No. 4,947,073 issued Feb. 5, 1985, to Deutsch discloses a glove including a padding portion which protects the back of a player's wrist and is securely attached to the glove portion by stitching. Such stitched attachment limits flexibility and adjustment and of glove. Hall et al includes a wrist protection band attached to the glove by a web. However, such a web does little to control adjustment of the wristband with respect to the glove.

Protection of the lower forearm is also a concern for people who utilize protective gloves, such as lacrosse players. These protective gloves must protect a player's forearm, yet it must not interfere with wrist flexibility. Deutsch, discloses a lacrosse glove in which the cuff portion is adjustably connected to the glove with removable lacings. The Hall patent discloses a sports glove provided with Velcro straps to secure the cuff around the wrist. Gloves of these designs do not prevent players from undoing such fasteners to improve their wrist flexibility. In fact, it is known that players commonly undo such straps, thereby causing the inner wrist portion to be exposed and unprotected, increasing the chances for injury. Additionally, Deutsch and Hall et al disclose cuffs that are secured to the glove portion by stitching. This stitching limits the flexibility of a player's wrist and also cannot be adjusted. Thus, it is a problem to design an adjustable cuff for a sports glove that protects a player's wrist and that does not compromise wrist flexibility.

SUMMARY OF THE PRESENT INVENTION

It is an object of the present invention to provide a protective athletic glove for utilization in contact stick sports such as lacrosse and hockey having an wrist guard that is coupled to glove to provide maximum protection and flexibility.

It is a further object of the present invention to provide a protective athletic glove for utilization in contact stick sports such as lacrosse and hockey having a the flexible joints of the glove skived to provide better protection for a player's hand and minimize injury thereto.

In accordance with the objects of the present invention, an improved protective sports glove is provided. The protective sports glove includes a hand protective portion. The hand protective portion has a palm portion, a thumb portion, and finger portions, interconnected by an inner fabric portion. The glove also includes an outer hand protective fabric structure that is connected to the inner fabric. The outer hand protective fabric has a plurality of outer protective padded formations disposed over the hand protective fabric structure, the thumb portion, and the finger portions. The padded formations are formed, such as by undercutting, such that at least one of the padded formations overlaps an adjacent padded portion when the two padded formations are joined. In this formation, when the glove is bent some or all of the inner fabric will continue to be overlapped to provide maximum protection to a player's when the glove is bent. The glove also includes a wrist protective portion that formed integral with the hand protective portion and a cuff portion coupled to the hand protective portion.

DETAILED DESCRIPTION OF THE PREFERRED EMBODIMENTS

Figure 2:
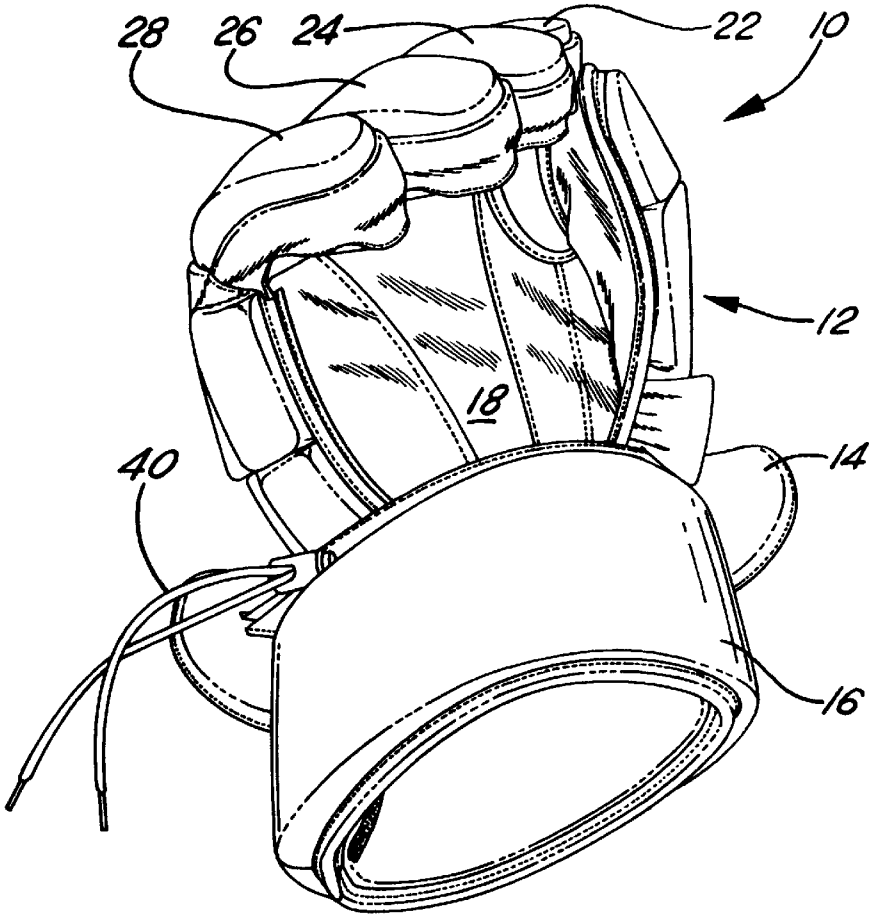
FIG. 2 is a bottom view of a protective sports glove in accordance with a preferred embodiment of the present invention.

Referring to FIGS. 1–9 there is shown a protective sports glove in accordance with the objects of the present invention. The glove 10 is preferably designed for use in contact stick sports such as lacrosse and hockey. The glove 10 is designed to receive a lacrosse player's hand therein.

In the preferred embodiment, the glove 10 has a hand protective portion 12, adapted to receive a hand therein, a wrist protective portion or wrist guard 14 for protection of a player's wrist, and a cuff portion 16 for protecting a player's lower forearm. The hand protective portion 12 includes a palm 18, a thumb 20, and four finger portions 22, 24, 26, and 28. The wrist guard 14 is coupled to the hand protective portion 12 and the cuff portion 16 for protecting a user's wrist.

The cuff portion 16 extends entirely around the lower part of the user's forearm to protect the forearm around all sides. With prior gloves that used laces, players would loosen or remove the laces to achieve additional flexibility at the expense of protection. The present glove with the integral wrist guard provides both increased flexibility and protection. Alternatively, the cuff portion 16 may be skived in an overlapping fashion, as is described in more detail below, to provide additional flexibility as well as additional protection as the cuff sections may overlap at the skive.

Instead of a single portion, the cuff portion 16 may alternatively be divided into separate sections to allow for additional protection and flexibility. Further, it may be desirable to have one cuff section overlap an adjoining cuff section to provide a double layer of protection at the wrist area that is particularly susceptible to contact while playing either lacrosse or hockey. Further, the cuff sections may additionally be skived to overlap, as is discussed in more detail below.

As shown in the Figures, the cuff portion 16 is preferably tapered in a direction toward the inside of the wrist to increase the flexibility and mobility of the player's wrist, for example, when cradling, shooting, scooping, and passing. It should be understood that the cuff portion 16 may be tapered in any direction, as may the individual cuff sections.

Figure 3:
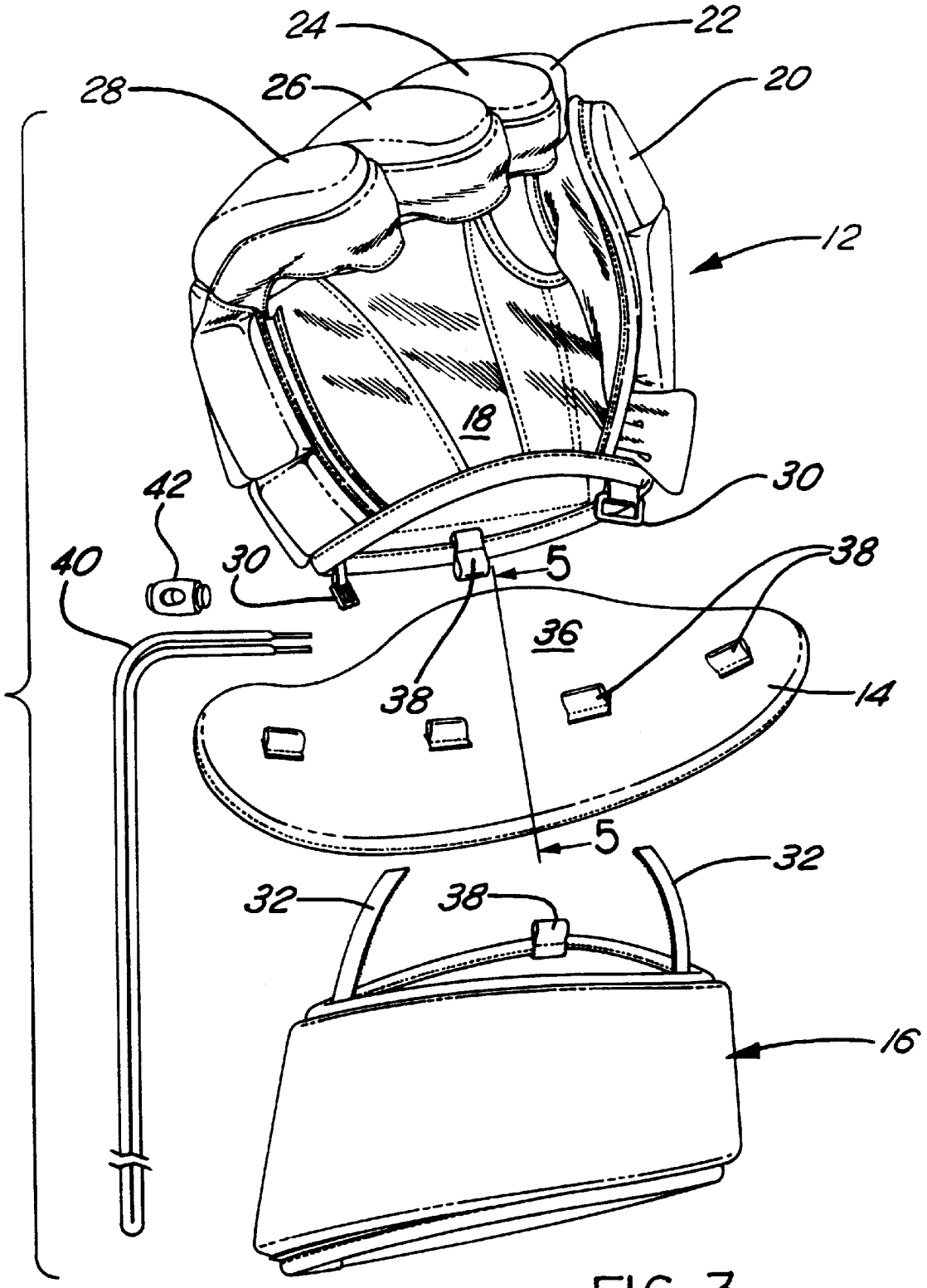
FIG. 3 is an exploded view of a protective sports glove in accordance with a preferred embodiment of the present invention.
Figure 4:
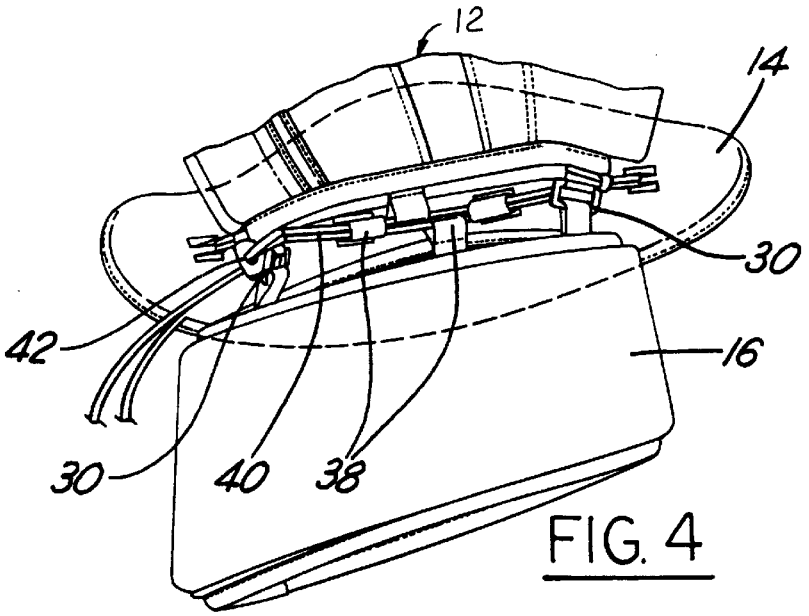
FIG. 4 is a sectional view of the attachment of the hand protective portion of the glove to the cuff portion of the glove in accordance with a preferred embodiment of the present invention.
Figure 5:
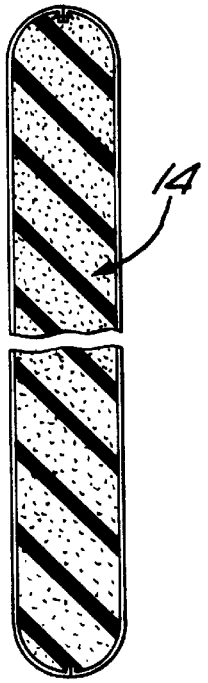
FIG. 5 is a cross-sectional view of the wrist guard along the lines 5—5 in FIG. 3.
Figure 6:
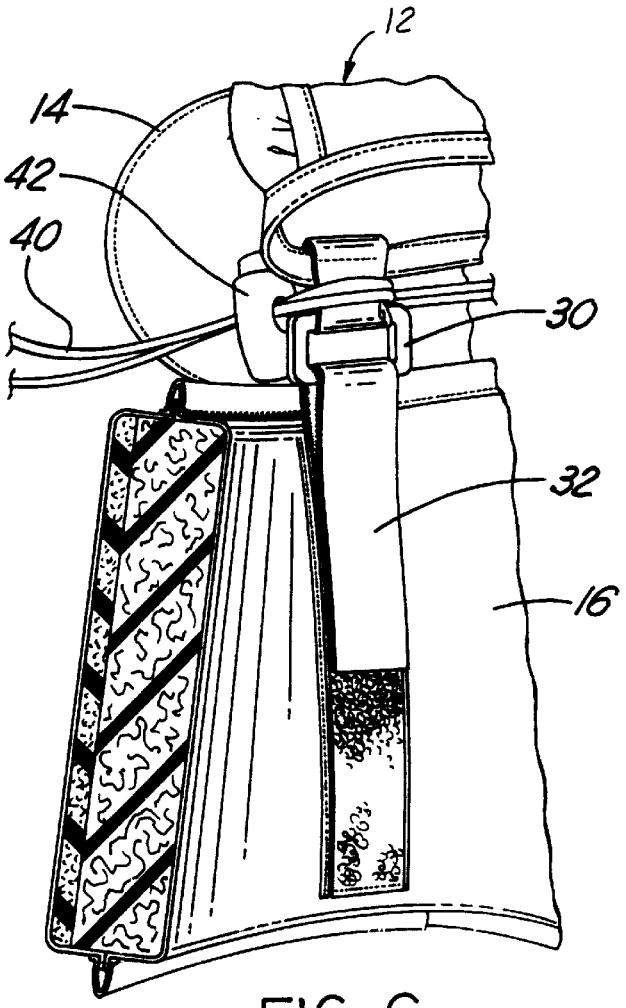
FIG. 6 is an enlarged sectional view of the wrist hinge portion in accordance with a preferred embodiment of the present invention.

In the preferred embodiment, a wrist hinge 30 flexibly connects the cuff portion 16 to the hand portion 12, as shown in FIGS. 3, 4, and 6. Preferably, the wrist hinge 30 is connected at each of the outer corners of the wrist, but may be attached anywhere along the mating area of the hand portion 12 and cuff 16. Moreover, the wrist hinge 30 may be comprised of a single attachment point located at the center back-of-wrist. An adjustable means, in the form of a band 32 of hook and loop fabric, particularly Velcro, is attached to the interior of cuff 16, and is threadedly connected through each hinge 30 to adjustably secure the cuff portion 16 to the hand portion 12. The wrist hinge 30 may be formed of molded thermoplastic material or may be formed of a webbing material that that extends between the cuff portion 16 and the hand portion 12.

Figure 1:
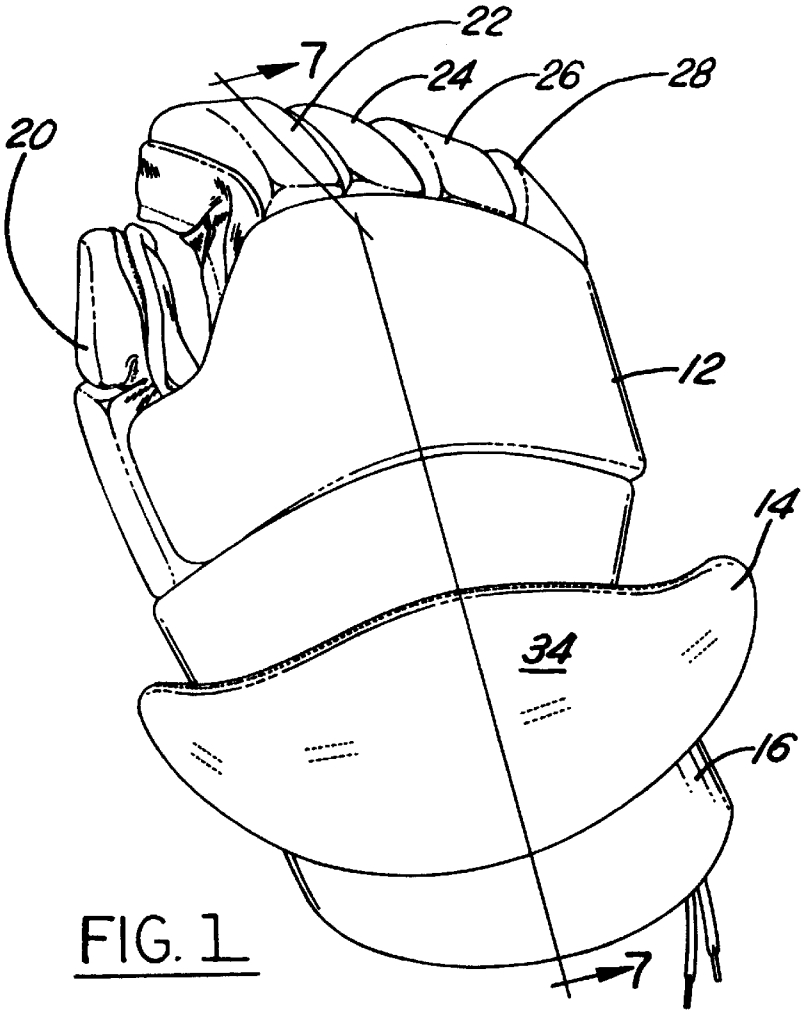
FIG. 1 is a top view of a protective sports glove in accordance with a preferred embodiment of the present invention.

The wrist guard 14 includes a front side 34 as shown in FIG. 1 and a backside 36 as shown in FIG. 3. A plurality of attachment mechanisms 38, such as loops or grommets, are formed along the backside 36 of the wrist guard 14. At least one attachment mechanism 38 is preferably also attached to the mating edges of the hand portion 12, and the cuff portion 16, for receiving a flexible cord 40. The cord 40 is alternately laced through loops 38 to secure the wrist guard 14 to the hand portion 12 and the cuff portion 16, as shown in FIG. 4. A cord lock 42 is slidably adapted to cord 40 for maintaining a desired fit of wrist guard 14, as shown in FIG. 6.

The wrist guard 14 is preferably formed integral with the glove 10 to prevent it from being removed. As shown in FIGS. 3, 4, 6, and 7, the protective hand portion 12 is preferably a separate piece from the cuff portion 16 and is formed in a separate process from the cuff portion 16. The protective hand portion 12, when joined to the cuff portion 16, is preferably spaced apart a limited distance to provide some flexibility for a player's wrist. However, because the hand portion 12 is separated from the cuff portion 16 the player's wrist is exposed and therefore subject to injury from a stick.

The wrist guard 14 is located at the back of the glove 10 to cover the space between the cuff portion 16 and the protective hand portion 12 and overlap both portions. Alternatively, the wrist guard 14 could overlap only the hand portion 12 or the cuff portion 16.

The spacing between the cuff portion 16 and the hand portion 12 forms a vent 15 to provide for increased airflow to a player's hand and therefore better ventilation to cool the player's hand, for example, on a hot day. While this ventilation is accomplished by spacing between the cuff portion 16 and the hand portion 12, it should be understood that it may be accomplished in other ways. Alternatively, the portions may be joined and a hole or vent 15 may be formed therein. Additionally, ventilation may be provided at other locations on the glove to increase the airflow to other parts of a player's hand, including the back of the hand and the fingers. The vents 15 may be formed by cutting or molding or any other known process.

Figure 7:
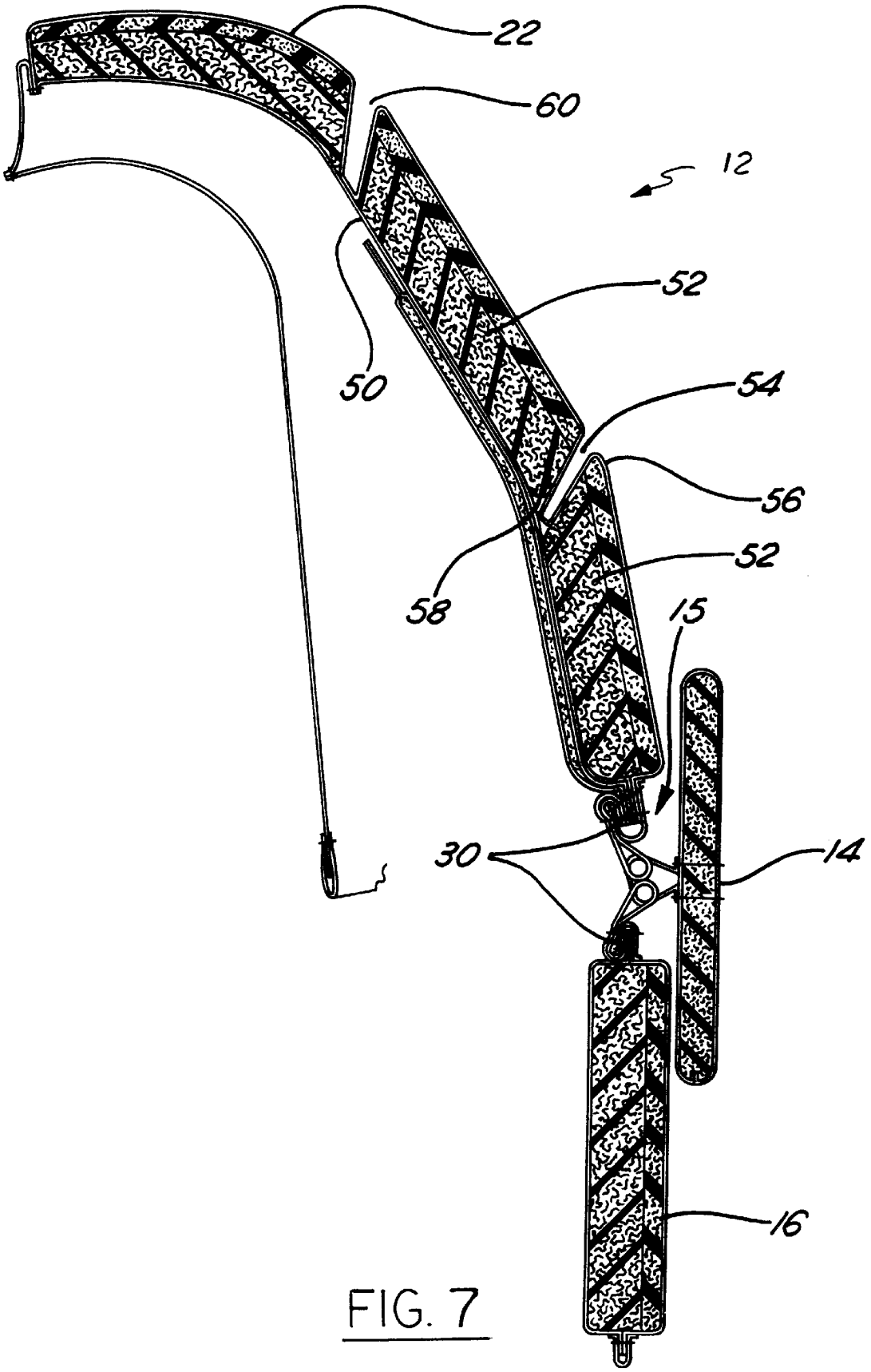
FIG. 7 is a cross-sectional side view of a protective sports glove in accordance with a preferred embodiment of the present invention.
Figure 8:
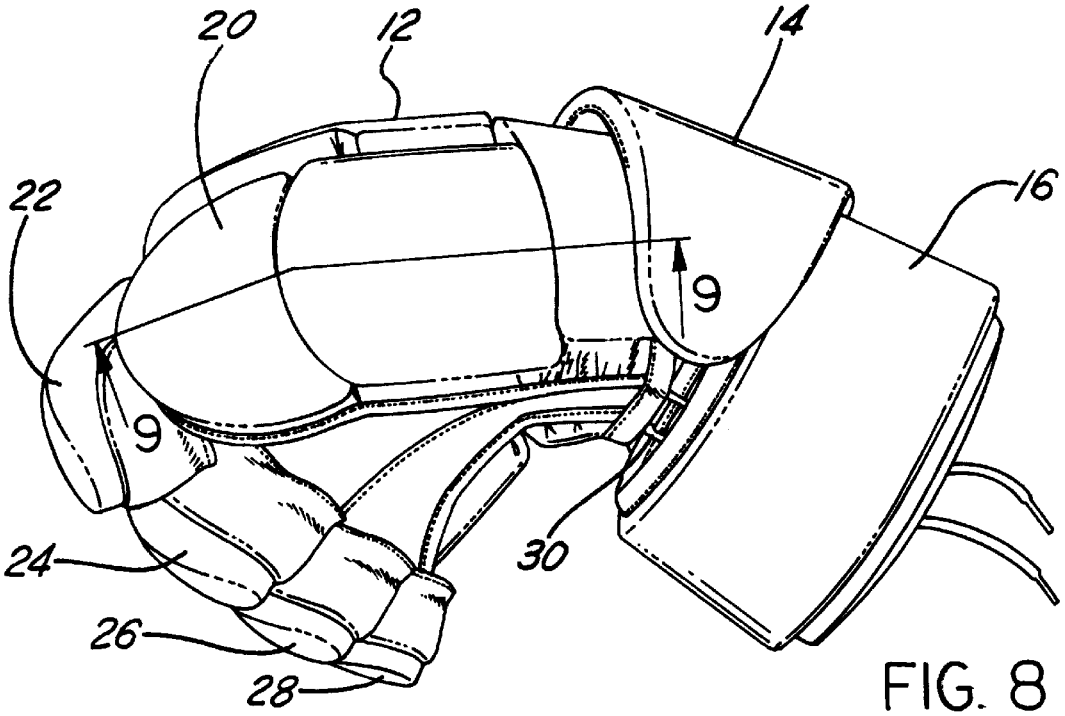
FIG. 8 is a side view of a protective sports glove in accordance with a preferred embodiment of the present invention.
Figure 9:
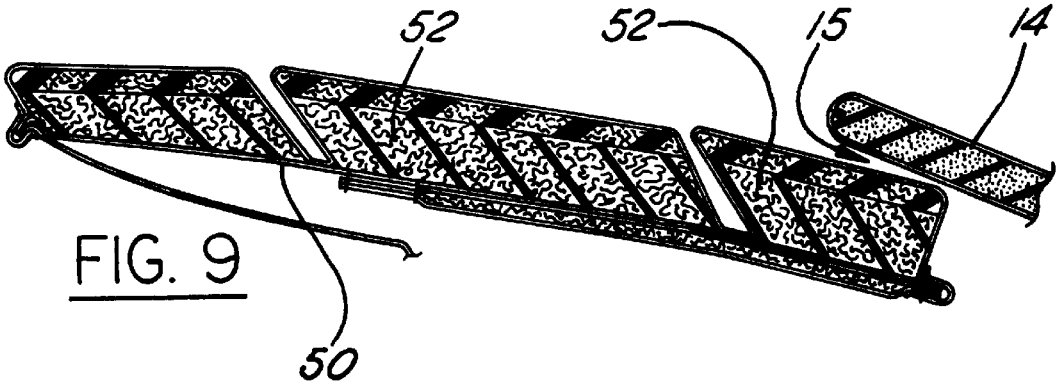
FIG. 9 is a cross-sectional view of the thumb portion of the protective sports glove shown in FIG. 8.

FIGS. 7 through 9 disclose the unique folding aspect of the present invention. The glove 10 is formed of an interconnected inner fabric 50 that has a plurality of protective padded formations 52 secured thereto, such as by sewing or the like. The protective padded formations are formed on the surface of the inner fabric 50 in sections to allow a player's hand to flex. Each padded formation 52 is formed adjacent to at least one other padded formation such that a seam 54 is formed between two adjacent padded formations 52. The adjacent padded formations 52 are preferably formed from foam, but may be formed from other padded materials.

Adjacent padded formations 52 are preferably formed such that as the glove 10 is bent at a seam, the edge of one adjacent padded formation 52 will overlap an edge of an adjacent padded formation 52. This overlapping of adjacent padded formations 52 can be accomplished by undercutting one edge of each padded formation 52.

As shown in FIG. 7, when a seam 54 is undercut, the top edge 56 of one adjacent padded formation 52 will overlap the bottom edge 58 of an adjacent formation 52. This undercutting provides a seam along which the glove 10 can bend and because one adjacent padded formation 52 overlaps the other adjacent padded formation, the inner fabric 50 is not exposed. Thus, the user's hand is more adequately protected than with prior gloves. Alternatively, the seams may be formed such that inner fabric 50 is partially exposed. This seam can be formed by skiving or any other known cutting process. Alternatively, the foam may be molded in an overlapping fashion. Moreover, while the padded formations 52 are preferably formed with a cloth covering, the padded formations 52 may be molded with overlapping seams and intended for use with no cloth covering.

It should be understood that the foam to foam construction may be an actual overlapping or shingle layering of one piece of protective material overlapping one another. This lobster-shell effect or split would provide an added degree of protection. The undercutting or overlapping may be utilized anywhere on the surface of the glove, including the thumb portion 20, finger portions 22, 24,26, 28, palm 18, wrist guard 14, hand portion 12 and cuff portion 16. Additionally, different styles may be utilized at different locations on the glove 10. Moreover, while the overlapping is shown in only one direction, it should be understood that the overlapping can be in any direction.

As shown in FIG. 7, the seam 60 between the fingers 22, 24, 26, 28 is hand portion 12 is lengthened to allow reverse flex of the fingers. This is particularly important for gloves that are intended for use in lacrosse. By reverse flex, the fingers are allowed to flex beyond parallel in a direction opposite the palm 18 or gripping direction.

We claim:

1. A protective sports glove, comprising:

a hand protective portion, said hand protective portion having a palm portion, a thumb portion, and finger portions, interconnected by an inner fabric portion;

an outer hand protective fabric structure connected to said inner fabric and having a plurality of outer protective padded formations disposed over said hand protective fabric structure, thumb portion and finger portions;

a separable wrist protective portion adjustably coupled to said hand protective portion; and a cuff portion coupled to said hand protective portion and extending entirely around a user's forearm.

2. The protective sports glove of claim 1, wherein said hand protective portion is attached to said cuff portion by a hinge.

3. The protective sports glove of claim 2, wherein said hinge is a two-point hinge with each point being located at the outer corners of a player's wrist.

4. The protective sports glove of claim 2, wherein said hinge is located at the center back of a player's wrist.

5. The protective sports glove as recited in claim 1 wherein said cuff portion is formed with overlapping portions.

6. The protective sports glove as recited in claim 1 wherein said padded portions are formed such that one padded formation overlaps an adjacent padded formation so that some of said inner fabric is overlapped when said adjacent padded portions are moved with respect to one another.

7. The protective sports glove as recited in claim 1 wherein said wrist protective portion is coupled to said hand protective portion by an adjustable cord.

8. The protective sports glove as recited in claim 1 wherein said cuff portion is tapered toward the inside of a user's wrist.

9. The protective sports glove as recited in claim 1 wherein the glove has at least one vent formed therein.

10. A protective sports glove comprising:

a hand protective portion, including a palm portion, a thumb portion, and plurality of finger portions;

a separable wrist protective portion coupled to said hand protective portion;

a cuff portion coupled to said hand protective portion, said cuff portion for extending entirely around a user's forearm; and a plurality of separate protective padded portions, that protect a user's hand while maintaining flexibility.

11. The protective sports glove as recited in claim 10 wherein said cuff portion has a first portion and a second portion wherein said first portion and said second portion overlap.

12. The protective sports glove as recited in claim 10 wherein said cuff portion is tapered toward the inside of a user's wrist.

13. The protective sports glove as recited in claim 10 wherein said plurality of padded formations are formed such that one of said padded portions overlaps an adjacent padded portion so that a user's hand is still protected when one of said adjacent padded portions is moved with respect to another of said adjacent padded portions.

14. The protective sports glove as recited in claim 10 wherein said hand protective portion is coupled to said cuff portion by a hinge.

15. The protective sports glove as recited in claim 14, wherein a pair of hinges, one located at each outer corner of a player's wrist, are used to couple said hand protective portion to said hinge.

16. The protective sports glove as recited in claim 14, wherein said hand protective portion is further coupled to said cuff portion by a hook and loop fastener strap and loop.

17. The protective sports glove as recited in claim 10 wherein said wrist guard is integral with said hand protective portion.

18. The protective sports glove as recited in claim 17 wherein said wrist guard is secured to said glove by an adjustable cord.

19. The protective sports glove as recited in claim 17 wherein said wrist guard overlaps any spacing between said hand protective portion and said cuff portion to protect a player's wrist.

20. The protective sports glove as recited in claim 16 further comprising vents formed in the glove to provide increased air flow to a player's hand.

21. The protective sports glove as recited in claim 10 wherein the distance between said hand protective portion and said cuff portion is adjustable.

* * * * *